United States Patent [19]

Schneider

[11] 4,286,452

[45] Sep. 1, 1981

[54] MACHINE FOR STRAIGHTENING ELONGATED WORKPIECES

[75] Inventor: Horst Schneider, Leichlingen, Fed. Rep. of Germany

[73] Assignee: Th. Kieserling & Albrecht Werkzeugmaschinenfabrik, Solingen, Fed. Rep. of Germany

[21] Appl. No.: 102,323

[22] Filed: Dec. 10, 1979

[30] Foreign Application Priority Data

Dec. 20, 1978 [DE] Fed. Rep. of Germany ..... 2855014

[51] Int. Cl.[3] ..... B21C 3/02

[52] U.S. Cl. ..... 72/164

[58] Field of Search ..... 72/160–165

[56] References Cited

U.S. PATENT DOCUMENTS

| | | | |
|---|---|---|---|
| 962,831 | 6/1910 | Naga | 72/164 |
| 1,835,198 | 12/1931 | Abramsen | 72/164 |
| 2,746,513 | 5/1956 | Kiesow et al. | 72/164 |

*Primary Examiner*—Milton S. Mehr
*Attorney, Agent, or Firm*—Michael J. Striker

[57] ABSTRACT

A machine for straightening elongated workpieces comprises a plurality of straightening rolls mounted one after the other to opposite sides of a workpiece to be straightened, substantially in a plane and turnable about axes normal to the direction of movement to the workpiece through the machine. At least the first three straightening rolls are mounted for rotation about their axes on a C-shaped support frame so that the workpiece may be introduced between the same from the open side of the C-shaped support frame. Lateral elements for centralizing the workpiece are coordinated with the first three straightening rolls. The second straightening roll and the centralizing elements coordinated therewith are movable in the aforementioned plane in a direction away from the first and the third roll through a large stroke accomplished by a quick adjusting mechanism, and to further facilitate lateral introduction of a workpiece from the open side of a C-shaped machine frame between the first three rolls, the centralizing element at this one side of the second roll can be tilted preferably about an axis parallel to that of the second roll in upward direction. The first three rolls and the elements cooperating therewith are preferably constructed as an independent machine unit.

10 Claims, 7 Drawing Figures

1
-13-
2
3
4
5
6
7
8
9
10
14
15
16
19
20
21
22
23
24
25
26
27
28
29
30
31
32
33
41
42
43
52
53
12
S
II
V

I
II
III
39
18
36
35
II
I+III
40
29
54
34
33
37
55
29
30
15
56
38

33
27
28
29
30
32
15
31
9
49
24
21
51
20
11
50
16
47
46
10
44
48
45

MACHINE FOR STRAIGHTENING ELONGATED WORKPIECES

BACKGROUND OF THE INVENTION

The present invention relates to a machine for straightening elongated workpieces and comprising a plurality of driven straightening rolls, preferably arranged in a vertical straightening plane, and turnable about their axes entending normal to the direction a workpiece to be straightened passes through the machine, in which the rolls are provided with profiles substantially corresponding to that of the workpiece to be straightened and in which at least part of the rolls are movable individually or in groups toward the workpiece.

Due to their simplicity and a series of known advantages, straightening machines of this type are widely used. However, a decisive disadvantage of straightening machines of the aforementioned kind consist in that they are able to straighten a workpiece only in one plate. A workpiece which is curved in two planes has therefore to be sent twice through such a straightening machine in order to obtain the desired straightness thereof. Due to this disadvantage such straightening machines are mainly used for straightening of workpieces of rectangular cross-section.

It is however known that workpieces having circular cross-sections, such as rods or wires, are usually curved only in one plane. For this purpose, the above-mentioned straightening machines are also used for straightening of workpiece of circular cross-section.

During such use of a straightening machine, the problem arises to introduce the workpiece into the machine in such a manner that the plane of curvature of the workpiece coincides with the straightening plane of the machine. Such a coordination could up to now be obtained only by the operator, respectively a manipulator. Thereby it was not only essential that the straightening plane coincides with the plane of curvature of the workpiece, but in addition it had to be assured that the curvature has the correct sense relative to the arrangement of the rolls in the straightening machine. If the curvature of the workpiece corresponds to the acting curvature of the second roll of the straightening machine, that is when the existing curvature of the workpiece to be straightened correspond or even surpasses the curvature transmitted to the workpiece in the first bending triangle, then the first bending triangle of the straightening machine will remain ineffective so that the straightening machine will not be fully used.

SUMMARY OF THE INVENTION

It is therefore an object of the present invention to simplify the introduction of rods or wires to be straightened into the above-mentioned straightening machine and to improve the straightening of the workpiece.

With these and other objects in view, which will become apparent as the description proceeds, the machine according to the present invention for straightening elongated workpieces mainly comprises support means, a plurality of driven straightening rolls profiled substantially according to the cross-section of the workpiece to be straightened and being mounted on the support means turnable about axes normal to the direction in which the workpieces pass through the machine, the plurality of rolls including, as considered in the aforementioned a first, a second and a third roll, mounted on the support means in such a manner that a workpiece may be introduced therebetween in a direction transverse to the passing through direction, means for adjusting the position of at least some of the other rolls toward the workpiece, means for adjusting the position of said second roll in a plane normal to the passing through direction and including the axis of the second roll relative to the first and the third roll and independent of the adjustment of the position of some of the other rolls, and at least partly movable means in the region of the three first rolls for centralizing the workpieces relative thereto.

In order to simplify explanation of the invention it is assumed that the bending plane of the straightening machine is a vertical plane and that the second straightening roll is arranged at a higher elevation than the first and third roll. The workpieces are introduced between the first three straightening rolls in lateral direction. Thereby the second straightening roll is raised. The introduction of individual workpieces from the side may be carried out automatically without any problems. By placing the curved workpiece onto a horizontal planar support, the curvature thereof will probably be located in a horizontal plane. Due to the curvature of the workpiece in the region of the first three straightening rolls, due to the lateral centralizing means coordinated with the first three straightening rolls and due to the fact that the first three straightening rolls will act at axially displaced portions of the workpiece, a turning moment will be imparted to the latter so that the curvature thereof will be turned to coincide with the bending plane. At the same time the workpiece will be centralized by means of the first three rolls and the lateral centralizing means coordinated therewith. Such an automatic turning of the workpiece will result as the lateral centralizing means move toward each other that is during lowering the second straightening roll. The lowering of the second straightening roll up to the turning of the workpiece is accomplished by a pneumatically operated cylinder and piston unit. The subsequent partly plastic bending of the aligned workpiece, which is accomplished by a further lowering of the second roll, is carried out by hydraulically operated cylinder and piston units. This will assure that the workpiece will not only be turned by the first three rolls so that the curvature of the workpiece will coincide with the bending plane, but that the workpiece will also be bent by the first three rolls, which will transmit the workpiece to the following straightening rolls, in a desired direction and magnitude. The straightening machine according to the present invention facilitates an automatic introduction of the workpiece into the machine and assures at the same time by the increased curvature imparted to the workpiece by the first three straightening rolls that this bending will be fully active for the straightening result obtainable by the machine.

The centralizing means comprise for each of the first three rolls a centralizing member having a pair of portions respectively located to opposite sides of the respective roll and provided with mutually inclined surfaces at opposite sides of the respective roll and respectively aligned with the profiles of the circumference thereof. These surfaces have distant from the roll end edges spaced from each other in such a manner to receive therebetween workpieces of a maximum curvature to be straightened.

The support means for the first three rolls and the elements cooperating therewith are preferably separable from the remainder of the straightening machine to be connectable to the remainder in different positions. This will assure that the workpiece may be introduced into the machine from one or the other side.

The first and the third roll are displaced in the passing through direction relative to the second roll and either the first or the third roll is preferably mounted on the support means adjustable in the afore-mentioned direction relative to the second roll. This permits an optimal arrangement of the degree of plasticizing the workpiece between the three first rolls and the required bending thereof so that the workpiece may pass properly through the following straightening rolls.

The second roll is adjustable in a direction normal to the passing through direction through a greater distance than any of the other rolls. Such a large stroke of the second roll is required for two reasons, i.e., for the first reason that for the centralizing of the workpiece a large stroke is required and for the second reason that the first three rolls of a straightening machine must be arranged so that the workpiece will be bent therebetween to a greater degree than by the following rolls.

It is to be understood that the first three roll are also rotated about the axes, even if the first three rolls are mounted on a separate support unit.

At least the second roll is mounted on a roll holder and at least one of said portions of the centralizing means located at the one side of the support means is mounted on the roll holder thereof tiltable about a tilting axis toward and away from the centralizing means of the other of the first three rolls and means are connected to the one portion for tilting the same about the tilting axis. In this way the opening to laterally introduce workpiece between the first rolls is considerably increased, without the necessity of increasing the stroke of the second roll.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBDDIMENT

Figure 1:
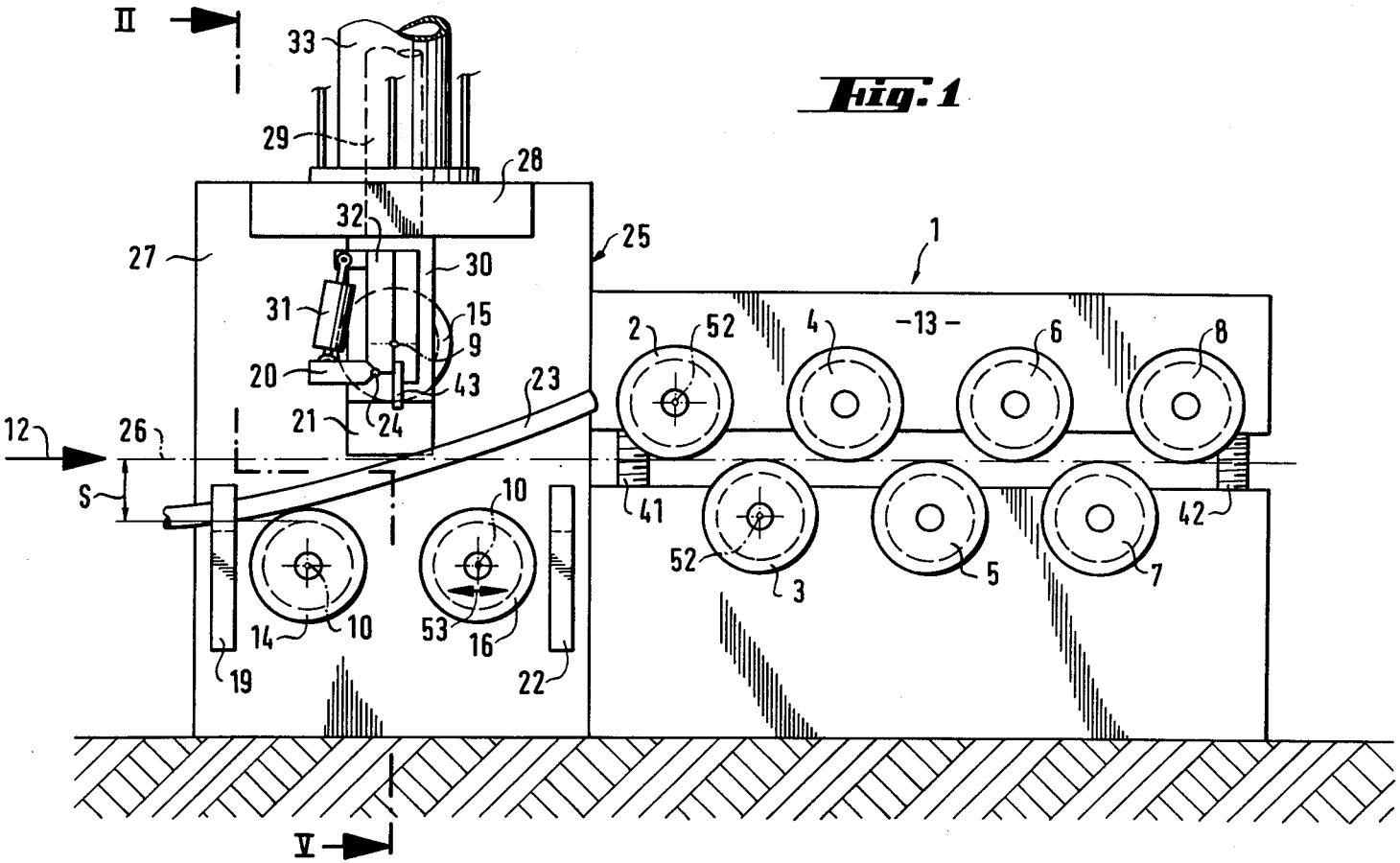
FIG. 1 is a schematic side view of the straightening machine according to the present invention.
Figures 6, 7:
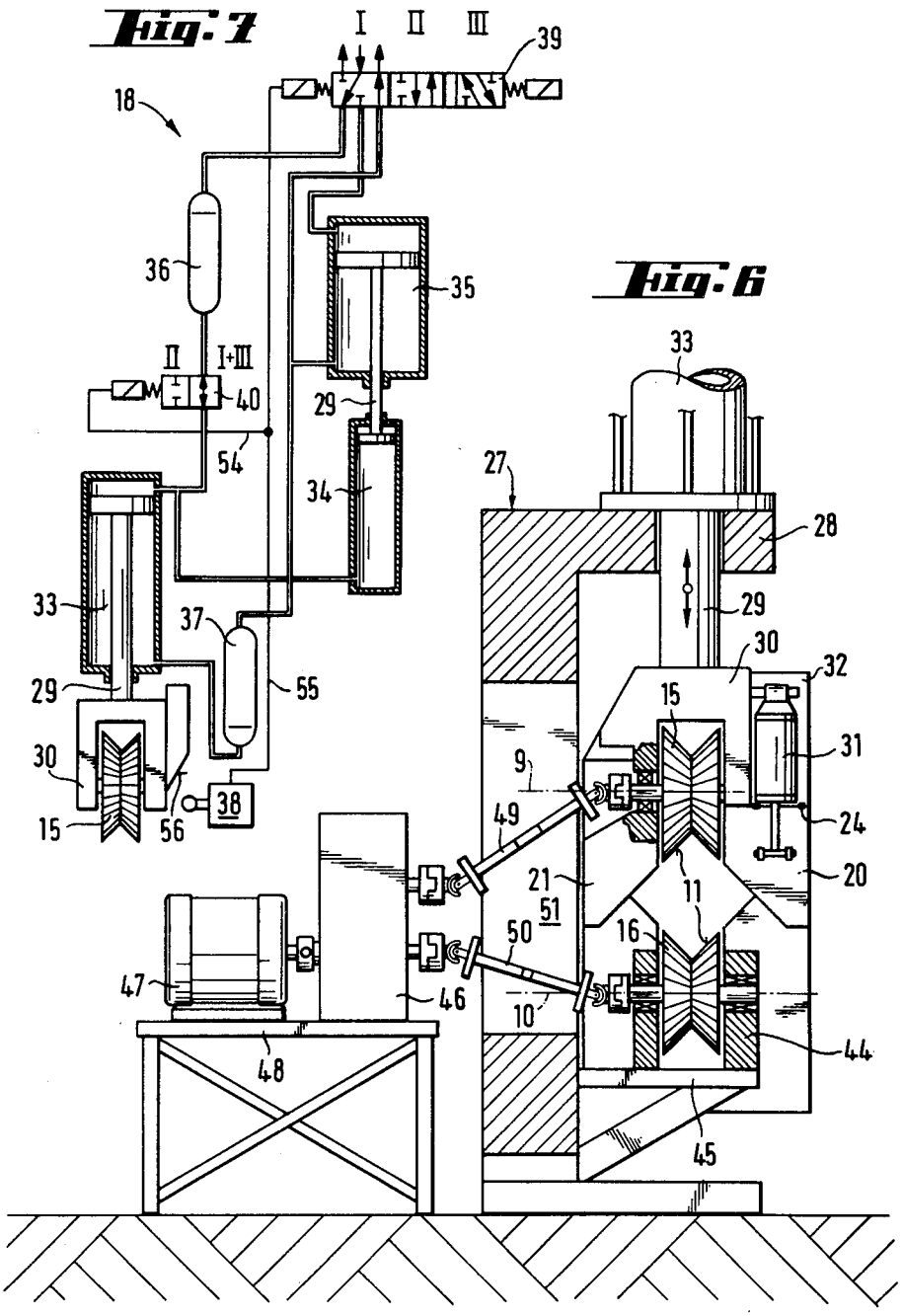
FIG. 6 is a cross-section similar to that shown in FIG. 4 and showing also the drive arrangement for the rolls.
FIG. 7 is a schematic view of the means for adjusting the position of the second straightening roll.

FIG. 1 schematically illustrate the straightening machine according to the present invention and it will be seen that this straightening machine includes a first roll 14, a second roll 15, a third roll 16 and a plurality of additional rolls 2–8. The rolls are arranged in a vertical plane turnable about their axes which extend at right angles to the direction a workpiece to be straightened passes through the machine as indicated by the arrow 12 and these rolls are respectively arranged in two groups to opposite sides of the central plane 26 of the machine and the rolls of each group are offset in the aforementioned direction with respect to the rolls of the other group. The periphery of each roll is provided with a profile 11 (FIG. 6). The straightening rolls 2–8 are provided with a round profile, whereas the first three straightening rolls 14–16 have a triangular profile. The rolls 2, 4, 6, and 8 are turnably mounted in a common cross head 13 and rotated by means not shown in the drawing. The cross head 13 is vertically adjustable by means of threaded spindles 41 and 42 toward and away from the workpiece 23 to be straightened in the machine. The lower straightening rolls 3, 5, 7 and 14 are turnably mounted in a stationary part of the machine frame. The straightening roll 16 is mounted in the machine frame movable in the passing through direction of the workpiece as schematically indicated by the double headed arrow 53. The straightening rolls 2–8 and 14, 16 may be mounted in overhung position on the support. The straightening roll 15 is mounted in a fork-shaped holder 30 connected to the lower end of a piston rod 29 movable in vertical direction by a cylinder and piston unit 33. The cylinder of the unit 33 is mounted on a cantilever plate 28 projecting laterally from the machine frame 27, as best shown in FIG. 6. The thus formed substantially C-shaped machine frame makes a lateral introduction of the workpieces between the first three straightening rolls possible. The second roll 15 is movable through a considerable stroke H (FIG. 5) toward and away from the workpiece, which is greater than the stroke by means of which the cross head 13 is movable on which the straightening rolls 2, 4, 6 and 8 are mounted. Movement of the second straightening roll 15 in vertical direction is accomplished by a quick adjustment mechanism 18 as schematically shown in FIG. 7. The quick adjusting mechanism 18 comprises two hydraulic cylinders 33 and 34, a pneumatically operated cylinder 35, two reservoirs or accumulators 36 and 37 for hydraulic fluid, two electromagnetically operated valves 39 and 40 and a limit switch 38. The limit switch 38 and the valves 39 and 40 are connected to each other by electrical conductors 54 and 55. Depending on the position of the valve 39 air under pressure is fed into the system or discharged therefrom. The hydraulic reservoirs 36 and 37 are provided with lower openings respectively connected to the cylinders 34 and 33 to receive hydraulic fluid displaced from the latter. The upper openings of the reservoirs 36 and 37, as well as the two chambers of the pneumatic cylinder 35 to opposite sides of the piston therein are connected with the valve 39. The lower opening of the reservoir 36 is connected to a valve 40 by means of which the lower opening may be opened or closed.

A cam 56 is connected to the roll holder 30 of the straightening roll 15 for operating the limit switch 38.

Figure 2:
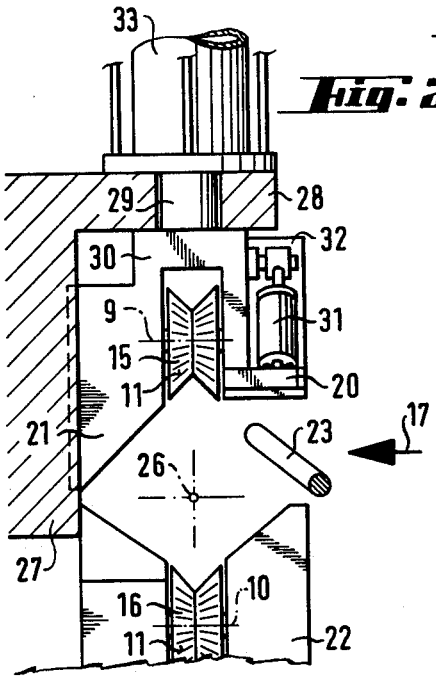
FIGS. 2–5 are sections taken along the line II–V of FIG. 1 and respectively illustrate the second roll of the straightening machine and the centralizing means cooperating therewith in different positions.

Centralizing means 19–22 for the workpiece 23 are arranged in the region of the first three straightening rolls 14–16. The centralizing means for each of the first three rolls comprise a centralizing member having a pair of portions respectively arranged to opposite sides of the respective roll and respectively provided with mutually inclined surfaces to opposite sides of the respective roll and respectively aligned with the profiles on the circumference thereof, these surfaces having distant from the rolls end edges spaced from each other in such a manner to receive therebetween the maximum curvature of a workpiece to be straightened. The portion 20 of the centralizing means for the second roll 15 which is located at the closed side of the machine frame 27 is integrally formed with the roll holder 30 and forms a continuation of the latter. The other portion 20 and the inclined face thereof which is located at the open side of the machine frame, that is at the side at which the workpiece 23 is introduced between the upper roll 15 and the lower rolls 14 and 16 is tiltably connected by means of a link 24 to the respective arm of the roll holder 30. The turning axis of the link 24 extends parallel to the axes 9 and 10 of the straightening rolls 14 and 16. As shown in FIG. 2 the portion 20 may be tilted upwardly to facilitate lateral introduction of the workpiece 23. A fluid operated cylinder and piston unit 31 connected to the roll holder 30 is provided for tilting the portion 20 of the centralizing means for the roll 15 about the aforementioned tilting axis. If the portion 20 of the centralizing means for the upper roll 15 is tilted in downward direction, then results, during lowering of the roll 15, a shutterlike decreasing of the open cross-section for the passage of the workpiece therethrough which centralizes the latter until the rolls engage the workpiece to bend the latter and transport the same in axial direction. The portion 20 is tilted downwardly until it abuts against an abutment 43 to form with the opposite portion 21 a passage of triangular cross-section. The straightening rolls 14–16 together with the C-shaped machine frame on which these rolls are mounted are constructed as an independent machine unit 25, which is arranged at the entrance end of the straightening machine. This makes it possible to turn the unit 25 through 180° about the axis of the cylinder 33 so that the workpieces may be introduced from the rear side of the machine instead of the front side as shown in FIG. 1.

In order to harmonize the required bending of the workpieces with the distance of the roll 2 following in the passing through direction of the workpiece the straightening roll 16, the latter is horizontally movably mounted on the machine frame 27.

The workpiece 23 is subjected to its greatest bending between the three first rolls. Due to the considerable inclination of the workpiece resulting therefrom special provision have in certain cases to be made so that the workpiece during its axial advance may move between the following straightening rolls. For this purpose the axes of the rolls 14 and 16 are located at a lower elevation than the axes of the rolls 3, 5 and 7, so that the bottom of the profiles of the rolls 14 and 16 are located at a distance S below the center plane 26 of the machine.

All of the straightening rolls are driven for rotation about their axes. The drive means for rotating the rolls 15 and 16 are shown in FIG. 6. These drive means include a motor 47 mounted on a table 48 and the output shaft of the motor 47 drives over a gearing unit 46 and universally joint shafts 49 and 50 the rolls 15 and 16. It is to be understood that an additional universal joint shaft extends between the gearing unit 46 and the straightening roll 14. The universal joint shafts extend through an opening 51 of the machine frame 27. The rolls 2–8 may be driven in a similar manner from an additional motor, an additional gearing unit, and additional universal joint shafts.

Different from the showing of FIG. 1, the lower roll 16 may be mounted for rotation about its axis in a roll holder 44 which in turn is mounted on a bracket 45 movable in the direction of the arrow 53 as shown in FIG. 1 by conventional mean not shown in the drawing.

Figure 3:
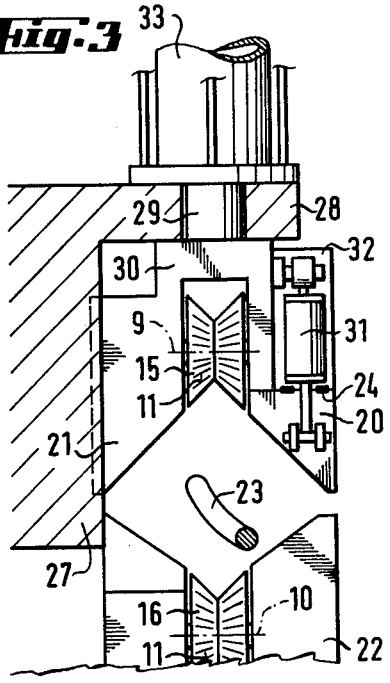
Figure 4:
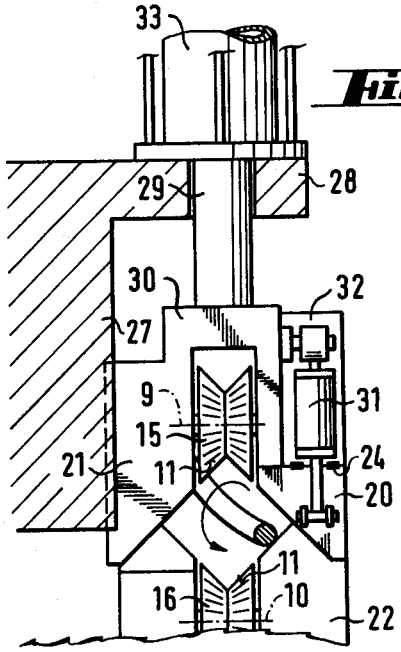
Figure 5:
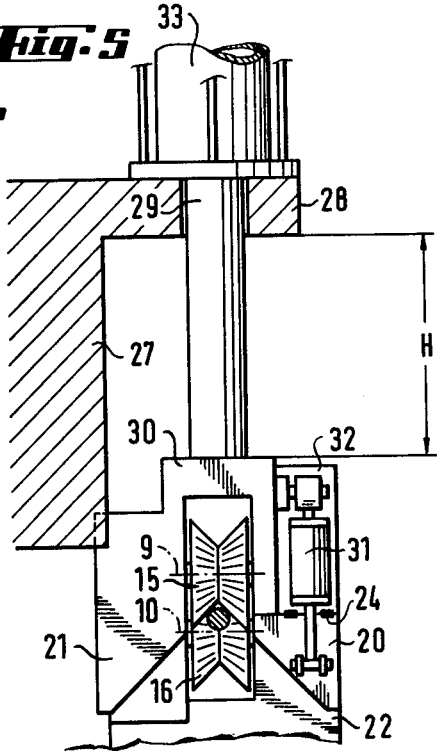

The above described machine will operate as follows:

The workpiece 23 is introduced laterally, in the direction of the arrow 17 as shown in FIG. 2, between the first three straightening rolls 14–16. Thereby the tilting portion 20 of the centralizing means for the upper roll 15 is tilted upwardly by means of the cylinder 31. The electromagnetic operated valves 39 and 40 are thereby in the position III so that compressed air, from a source of compressed air not shown in the drawing, will flow into the lower compartment of the pneumatically operated cylinder 35 and into the upper end of the reservoir 37 to displace hydraulic fluid therein into the lower compartment of the cylinder 33 so that the roll holder 30 and the straightening roll 15 mounted thereon move in upward direction. After a workpiece 23 has been introduced between the straightening rolls 14–16, the tiltable portion 20 of the centralizing means for the roll 15 is tilted downwardly by the cylinder 31 to the position shown in FIG. 3. Subsequently thereto the six-port, three position valve 39 is moved, by not illustrated control means, to the position I as shown in FIG. 7. In this position compressed air is fed into the upper end of the reservoir 36 so that hydraulic fluid therein passes through the valve 40, likewise in the position I into the upper compartment of the hydraulically operated cylinder 33 so that the roll holder 30 and the straightening roll 15 mounted thereon move downwardly, while simultaneously fluid is also displaced into the lower compartments of the hydraulic cylinder 34 so that the piston rod 29 between the pistons in the cylinders 34 and 35 moves upwardly to thereby compress the air in the upper compartment of the cylinder 35, which is prevented from flowing out of the same in the position I of the valve 39. During this fast movement of the holder 30 for the roll 15 to the position as shown in FIG. 4, the workpiece is turned by the turning moment created by the centralizing means 20 so that the plane defined by the curved workpiece coincides essentially with the straightening plane formed by the rolls of the machine. The workpiece is thereby placed in a position so that the ends thereof point in upward direction. Shortly before the holder 30 reaches the position as shown in FIG. 5, the cam 56 thereon will engage the limit switch 38. This limit switch 38 is connected to the solenoids at the left sides of the valves 39 and 40, so that the valve member thereof will be moved to the position II. In the position II the lower end of the reservoir for hydraulic fluid 36 will be closed and the roll 15 will be further lowered with a force resulting from the pressure translation in the cylinders 33, 34 and 35 so that the roll 15 is pressed with a multiple of the previously existing force against the workpiece and the up to now existing curvature of the workpiece will be considerably increased during further downward movement of the roll 15. The aforementioned pressure translation will result from the fact that the active surface of the piston in the cylinder 35 is greater than the active surface of the piston in the cylinder 34, whereby the two pistons are connected to each other by the common piston rod 39. A further pressure translation is obtained in that the active surface in the cylinder 33 is greater than that in the cylinder 34. The fluid displaced from the cylinder 33 passes into the reservoir 37, whereas the air displaced thereby from the reservoir 38 flows out of the same over the valve 39 in the position II. In this position II of the valves 39 and 40 the roll 15 is lowered until the workpiece obtains the desired curvature. The drive for all straightening rolls is switched on, in a manner known per se by a non-illustrated limit switch, when the roll 15 reaches its lowermost position. After a workpiece has passed in axial direction through the machine, the valves 39 and 40 are for instance by a non-illustrated electric eye in circuit with the valves 39 and 40 again moved to the position III so that the roll 15 is again moved in upward direction. A new workpiece may then be placed in the machine and the afore-described cycle repeated.

The dimension S at which the acting peripheral surface of the rolls 14 and 16 is displaced downwardly with respect to the following rolls 3, 5 and 7 at the same side of the workpiece, is dimensioned in such a manner that the workpiece with the largest polar movement of inertia, which receives the necessary plasticizing by being bent while passing through the first straightening rolls 14, 15 and 16, may just pass between the following straightening rolls 2 and 3.

It will be understood that each of the elements described above, or two or more together, may also find a useful application in other types of machines for straightening of elongated workpieces differing from the types described above.

While the invention has been illustrated and described as embodied in a machine for straightening elongated workpieces it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A machine for straightening of elongated workpieces, comprising support means; a plurality of driven straightening rolls profiled substantially according to the cross-section of the workpiece to be straightened and being mounted on said support means turnable about axes normal to the direction in which the workpiece passes through the machine, said plurality of rolls including, as considered in said direction a first, a second and a third roll mounted in said support means in such a manner so as to be accessible from one side of the machine; means for adjusting the position of at least some of the other rolls towards the workpiece; means for adjusting the position of said second roll in a plane normal to said passing through direction and including the axis of said second roller, relative to said first and third roll and independent from the adjustment of the position of said other rolls; and at least partly movable means in the region of the first three rolls for centralizing the workpieces relative thereto.

2. A straightening machine as defined in claim 1, wherein said means for adjusting the position of said second roll comprises fast adjusting means including a first hydraulically operated cylinder and piston unit connected to said second roll and a second hydraulically operated cylinder and piston unit as well a pneumatically operated cylinder and piston unit in circuit with said first cylinder and piston unit.

3. A straightening machine as defined in claim 1, wherein said centralizing means comprises for each of the first three rolls a centralizing member having a pair of portions respectively provided with inclined surfaces to opposite sides of the respective roll and respectively aligned with the profile on the circumference thereof, said surfaces having distant from the rolls end edges spaced from each other in such a manner to receive therebetween a workpiece to be straightened having a maximum curvature.

4. A straightening machine as defined in claim 1, wherein the support means for said first three rolls and the elements cooperating therewith are separated from the remainder of the straightening machine to be connectable to the remainder in different position.

5. A straightening machine as defined in claim 1, wherein said first and said second roll are displaced in said passing through direction relative to said second roll, and wherein at least one of said displaced rolls is mounted on the support means adjustable in said direction relative to said second roll.

6. A straightening machine as defined in claim 1, wherein said second roll is adjustable in a direction normal to said passing through direction through a greater distance than any of the other rolls.

7. A straightening machine as defined in claim 1, wherein said plurality of rolls are arranged in two groups respectively located to opposite sides of the workpiece passing through said machine and in which said first and said third roll are spaced from an imaginary straightened center line of a workpiece passing through said machine a greater distance than the following rolls on the same side of the workpiece as the first and third roll.

8. A straightening machine as defined in claim 3, wherein at least said second roll of the first three rolls is mounted on a roll holder and wherein one of said portions of the centralizing means located at said one side of the support means is mounted on the roll holder thereof tiltable about a tilting axis toward and away from the centralizing means of the other of the first three rolls, and means connected to said one portion for tilting the same about said tilting axis.

9. A straightening machine as defined in claim 8, wherein said tilting axis extends substantially parallel to the axis of the respective roll and wherein said means for tilting said portion of the centralizing means about said tilting axis comprises fluid-operated cylinder and piston means on the respective roll holder.

10. A straightening machine as defined in claim 1, wherein said plurality of straightening rolls are arranged in two groups respectively located at opposite sides of a workpiece to be straightened with the rolls in each group spaced in said direction from each other and the rolls in one group offset in said direction with respect to the rolls in the other group.

* * * * *